United States Patent [19]

Hirohata

[11] Patent Number: 4,631,868

[45] Date of Patent: Dec. 30, 1986

[54] METHOD AND AN APPARATUS FOR GRINDING A ROD-LIKE OBJECT

[75] Inventor: Nobuyuki Hirohata, Yakayama, Japan

[73] Assignee: Sanko Kikai Co., Ltd., Wakayama, Japan

[21] Appl. No.: 678,031

[22] Filed: Dec. 4, 1984

[30] Foreign Application Priority Data

Feb. 6, 1984 [JP] Japan ..... 59-20198

[51] Int. Cl.[4] ..... B24B 41/06; B24B 5/18

[52] U.S. Cl. ..... 51/128; 51/103 TF; 51/236; 51/238 GG

[58] Field of Search ..... 51/128–129, 51/215 SF, 238 GG, 103 WH, 103 TF, 236, 289 R, 109, 138, 139, 54, 56 R, 59 R, 165.92

[56] References Cited

U.S. PATENT DOCUMENTS

| | | | |
|---|---|---|---|
| 1,558,511 | 10/1925 | Smith | 51/109 R |
| 1,733,086 | 10/1929 | Sobolewski | 51/103 TF |
| 1,733,090 | 10/1929 | Holmes | 51/103 TF |
| 2,397,298 | 3/1946 | Stenwall | 51/134 |
| 2,481,173 | 9/1949 | Stenwall | 51/236 |
| 3,041,793 | 7/1962 | Shimizu | 51/109 X |
| 3,541,735 | 11/1970 | Schaller et al. | 51/139 |
| 3,845,588 | 11/1974 | Huffman, Jr. | 51/139 |
| 4,222,203 | 9/1980 | Wolff et al. | 51/54 X |

*Primary Examiner*—Frederick R. Schmidt
*Assistant Examiner*—Debra S. Meislin
*Attorney, Agent, or Firm*—Wenderoth, Lind & Ponack

[57] ABSTRACT

This invention discloses a method and an apparatus for grinding and polishing up a rod-like object which has such a comparatively small diameter that the rod is pliable when subjected to usual grinding. Upon grinding, it is placed on a horizontal, rotatable roll with a surface having great frictional resistance and held by a pair of parallel, opposed guide plates on both sides, where it is made to rotate by the rotation of the roll while a rotating grindstone is being pressed on it. Uniform grinding can be made by moving the grindstone and the rod-like object relative to each other along a gap between the parallel, opposed guide plates.

14 Claims, 11 Drawing Figures

METHOD AND AN APPARATUS FOR GRINDING A ROD-LIKE OBJECT

BRIEF SUMMARY OF THE INVENTION

This invention relates to a method of grinding and polishing up a rod-like object with a grindstone and an apparatus for accomplishing the same.

Conventionally, a rod-like object is ground under rotation with a rotating grindstone being pressed and moved back and forth on it. However, a conventional apparatus used for this type of grinding has a chuck and a tailstock for holding a rod-like object, a means for pressing a grindstone on the object and a means for moving the grindstone while keeping constant contact pressure with the object.

The problem with this type of apparatus is that when a grindstone is pressed against a rod-like object held by a chuck and a tailstock, a considerable force is applied to the object in its radial direction which causes it to bend and prevents it from beign ground.

Therefore, it is an object of this invention to provide a method of grinding a pliable rod-like object of comparatively small diameter.

It is another object of this invention to provide an apparatus capable of performing accurate grinding of a rod-like object over its entire length.

It is a further object of this invention to provide an apparatus simple in structure which is capable of easily performing the above mentioned grinding.

BRIEF DESCRIPTION OF THE DRAWINGS

The above and other objects and features of this invention will become more fully understood hereinafter from a consideration of the following description taken in connection with the accompanying figures wherein one example is illustrated by way of example.

DETAILED DESCRIPTION

Figure 1:
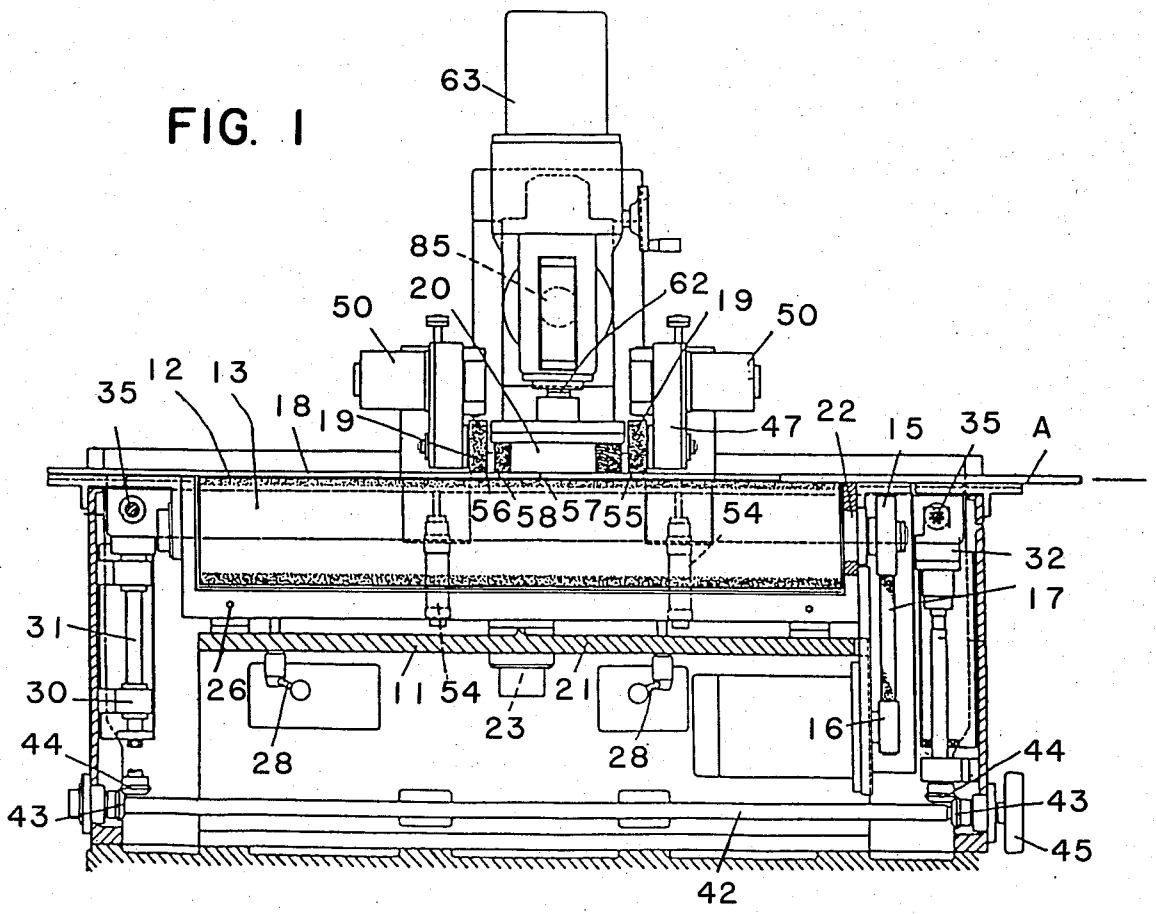
FIG. 1 is a cross-sectional elevation view of an apparatus of this invention.

As shown in the figures, a roll 12, which rotates about a horizontal axis and which is covered with material 13 having a large coefficient of friction, is disposed horizontally above a base plate 11. A motor 14, mounted on the base plate 11, rotates the roll 12 by means of pulleys 15, 16 and a belt 17, while a pair of guide plates 18, 18' are disposed a little above the top of the roll 12 and on both sides of the horizontal axis of the roll 12.

The material 13 covering a roll 12 is rubber or the material which has an effect similar to rubber. The guide plates 18, 18' are disposed on either side of a rod-like object which is placed longitudinally on the rotating roll 12 in such a way that it does not move from between the guide plates can rotate as the roll rotates.

Disposed directly above the guide plates 18, 18' is a pressure roll 19 for pressing the rod-like object A down with enough pressure on the rotating roll 12 to transmit the rotation of the roll 12 to the object. A grinder such as a rotatable, grindstone 20, is provided for grinding the surface of the object while keeping constant contact, pressure with it. The roll 12 is held at both ends by a bearing 22 secured to a stay extending from both ends of a rotatable plate 21, whose center is pivotably fastened to a swivel joint 23 positioned on the base plate 11, so that the roll 12 is permitted to rotate in a horizontal plane about the swivel joint, as rotate well as around its rotational axis.

Figure 2:
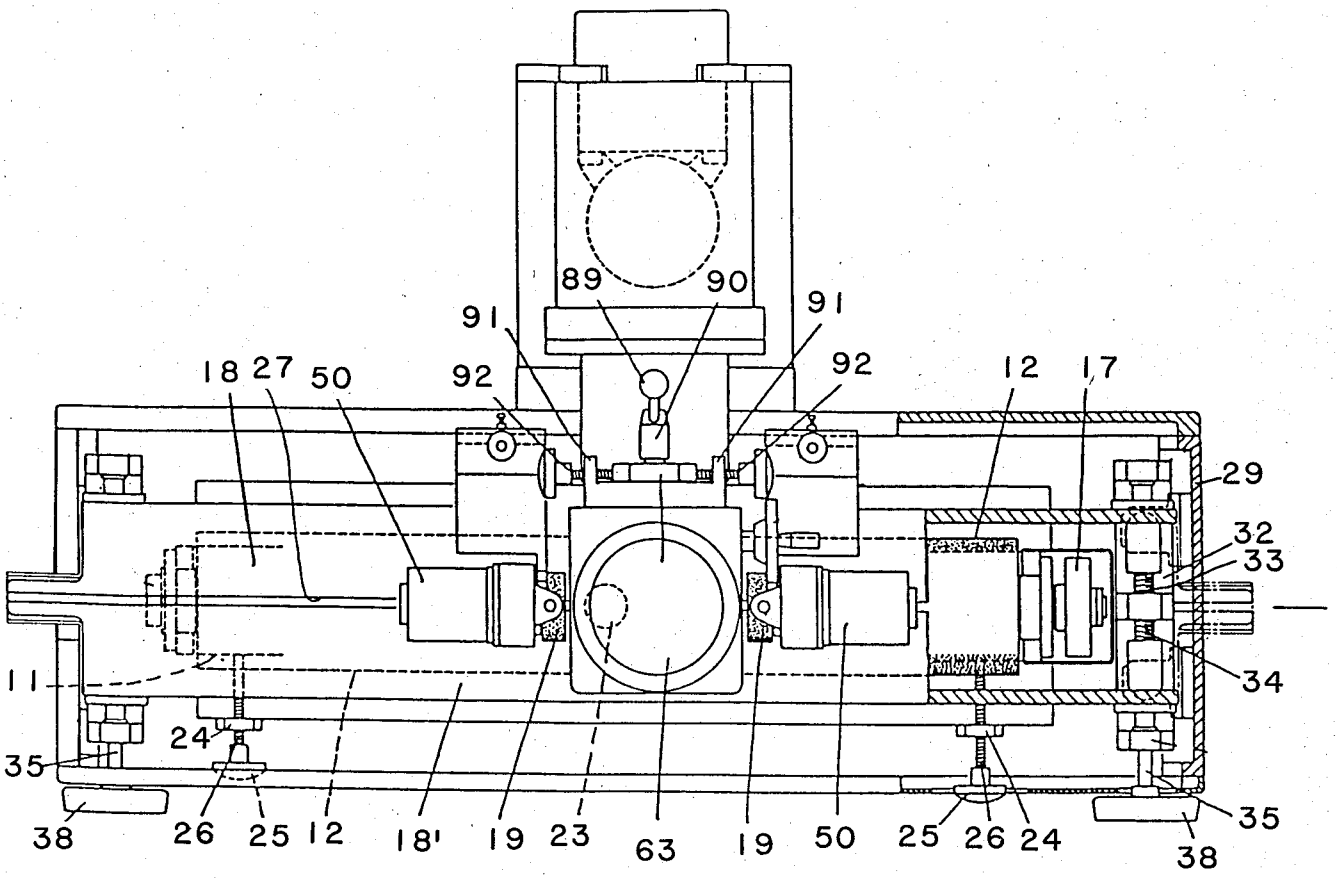
FIG. 2 is a partially cutaway plan view of an apparatus of this invention.
Figure 6:
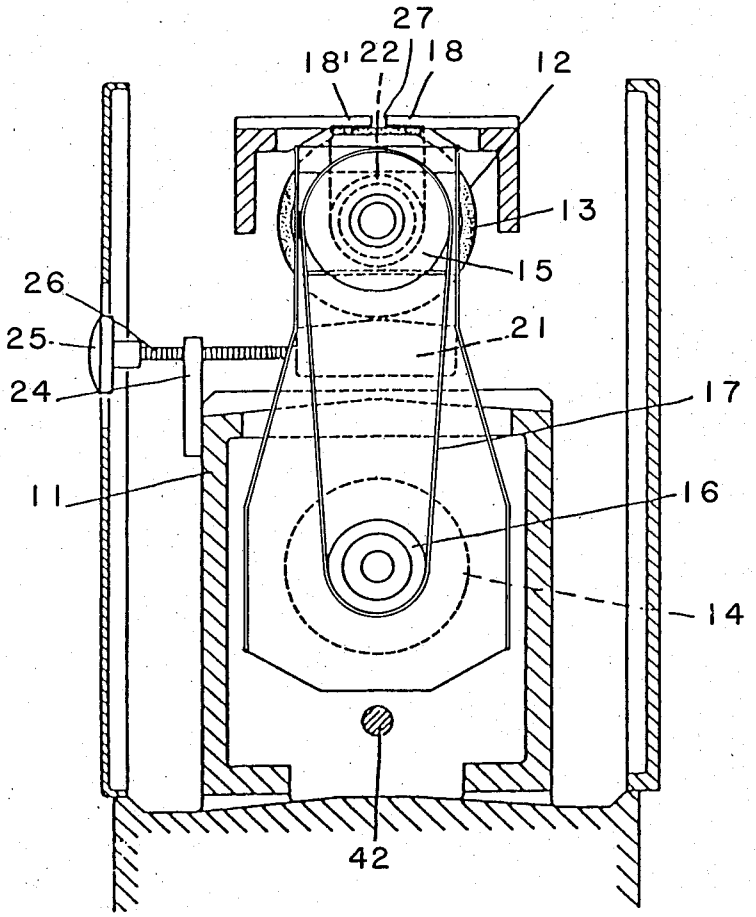
FIG. 6 is a cross-sectional side elevation view of an apparatus of this invention which shows a part for driving a roll to be put under rotation during grinding.

As is apparent from FIGS. 2 and 6, a thumb screw 26 with a head 25 is screwed into a stay 24 until its front end comes into contact with the plate 21. Hence, by adjusting a thumb screw 26 on both sides of the swivel joint 23 the feed angle between the roll 12 and a gap 27 formed between the guide plates 18, 18' can be changed in addition, the feed angle can be fixed by means of a lock levers 28 provided on either side of the swivel joint 23.

The roll 12, thus turned in a horizontal plane and angled relative to the gap 27 between the parallel, opposed guide plates 18, 18', gives the rod-like object not only the rotational movement around its axis but a longitudinal movement in its axial direction between the guide plates always prevent the object from moving laterally from the gap 27. The rate of the longitudinal movement can be varied by changing the feed angle returner the roll 12 and the gap 27.

Figure 5:
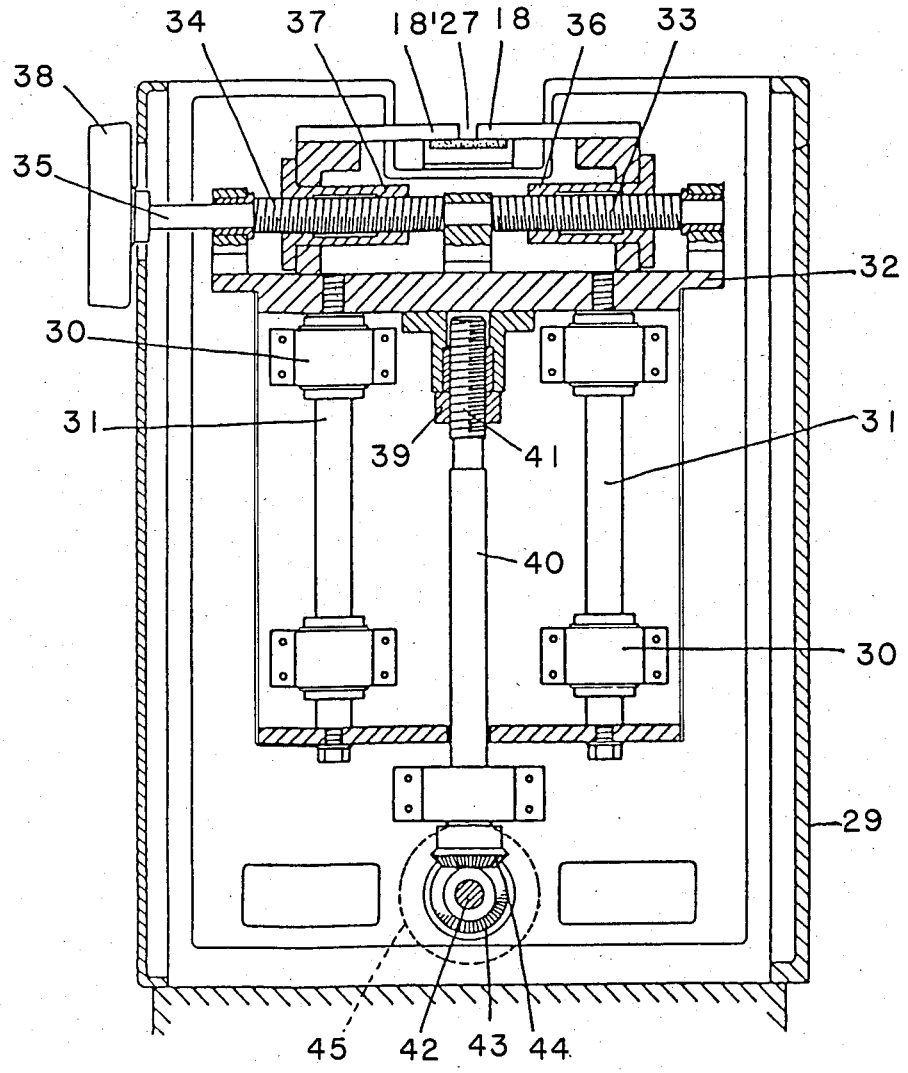
FIG. 5 is a cross-sectional side elevation view of an apparatus of this invention which shows a mechanism for adjusting the height and the width of a gap between the guide plates in relation to a rod-like object to be ground.

As shown in FIGS. 2 and 5, the guide plates 18, 18' are supported by struts 36,37, respectively, disposed on a lifting bed 32. The lifting bed 32 is supported on vertical guide shafts 31 which pass through respective guides 30. The guides 30 and the guide shafts 31 are disposed at each end of a housing 29 which covers the base plate 11. A screw 35 with right-hand external thread 33 and left-hand 34 external threads thereon is engaged with respective internal threads in each strut 36,37 thus the width of the gap 27 between the guide plates can be varied in correspondence with diameter of the object A to be ground by turning a handle 38 attached to the screw 35.

There is provided an internal thread 39 on a part extending beneath the lifting bed 32. An external thread 41 on the upper end of a vertical shaft 40 meshes with the internal thread 39 and the lower end of the shaft 40 communicates with a horizontal shaft 42 by means of a set of bevel gears 43, 44. Hence, the guide plates 18, 18', together with the lifting bed 32, can be raised or lowered freely in accordance with the diameter of the object to be ground by turning a handle 45 attached to the shaft 42.

As explained above, the width of the gap 27 and the height of the guide plates above the top of the roll 12 can be adjusted at will so as to be able to grind rod-like objects of different diameters.

It is also possible to rotate the guide plates 18, 18' together with the rotatable plate 21 and choose the most appropriate feed angle between the roll 12 to the gap 27 by means of attached to the rotatable plate 21, a worm wheel, engaged with the worm wheel a worm gear connected to the worm gear with a clutch therebetween and a motor the rotatable plate 21 is stopped from turning by operation of the clutch and the motor when the gap between the guide plates is at a desired feed angle to the roll 12.

Figure 4:
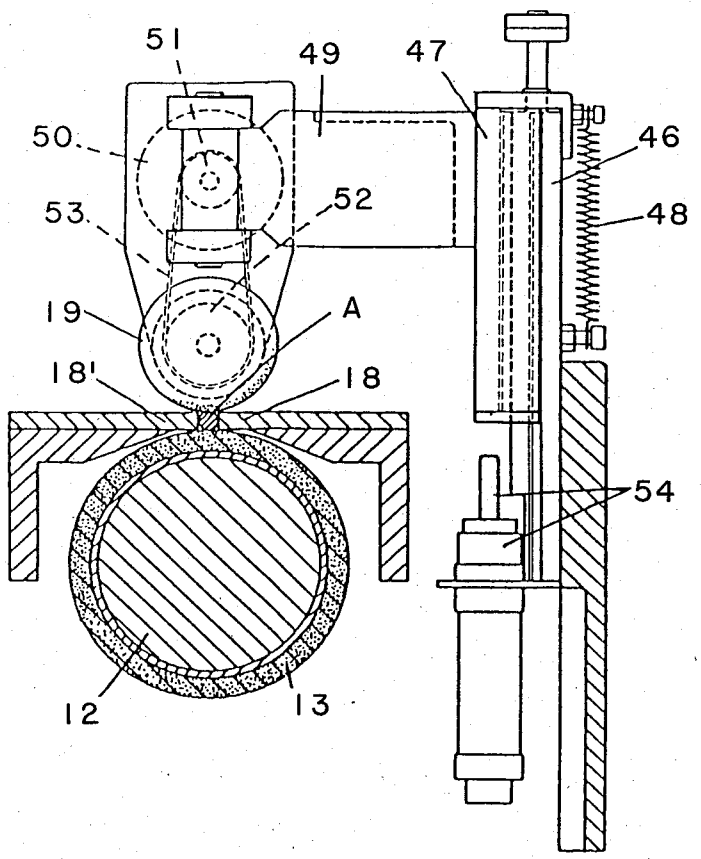
FIG. 4 is a corss-sectional side elevation view of an apparatus of this invention which shows a pressure roll in FIG. 3 in more detail in association with other related members.

As shown in FIG. 4, a pressure roll 19 is supported on a column 46 for pressing the rod-like object down on the rotating roll 12 cause the rod-like object to rotate by virtue of the rotation of the roll 12. A pair of columns 46, each of which stands at the back side of the 29 housing, are provided in such a way that the grindstone 20 can also be put between the columns.

The pressure roll 19, attached to the lower end of an arm 49 which extends from the front side of a carriage 47, is biased downward the force of. a spring 48 A 50 with a pulley 51 is connected by a belt 53 to a pulley 52 on pressure roll 19 such that the pressure roll 19 can rotate at the same speed as the roll 12, pressing thereby the rod-like object A down and forcibly rotating it on the roll 12.

In addition, it is also possible to raise and lower the pressure roll 19 relative to the rod-like object A by means of a cylinder 54 joined to the carriage 47. The cylinder 54 moves the pressure roll 19 up and down, in response to signals from two sensors 55, 56 which are disposed in the gap 27 to detect the front and rear ends of the rod-like object A. One gap sensor 55 detects the front end of the rod-like when it object is just beneath the pressure roll 19 and signals the cylinder 54 to retract so as to lower the pressure roll 19 at the proper time. The other sensor 56 detects the rear end of the rod-like object leaving the pressure roll and signals the cylinder 54 to expand so as to raise the pressure roll 19 thus preparing it for the entering of the next object.

The grindstone 20 is moved up and down above the guide plates 18, 18' in an automatic fashion as well by two sensors 57, 58 placed in the gap 27.

Figure 3:
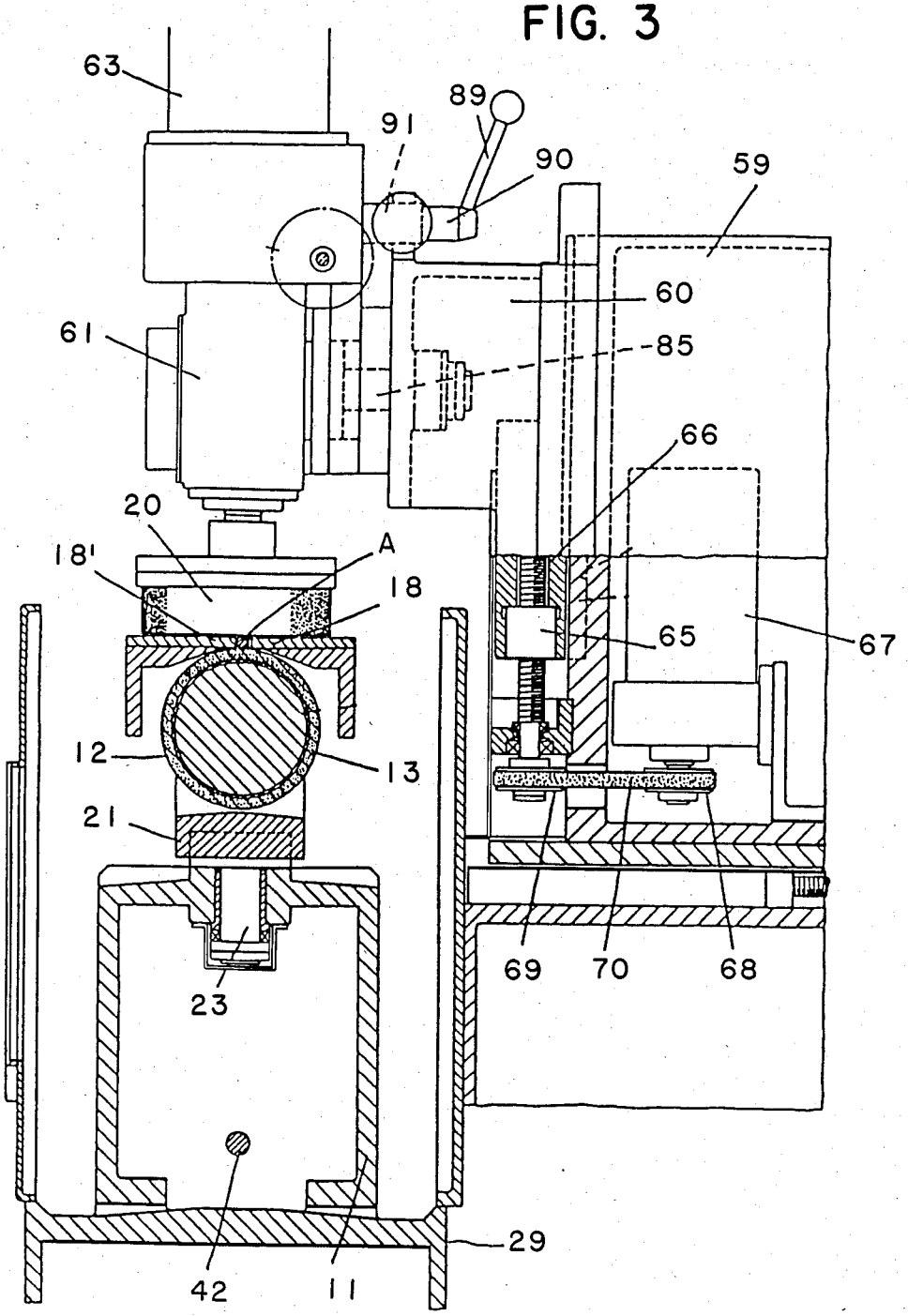
FIG. 3 is a cross-sectional side elevation view of an apparatus of this invention which shows essential parts of this apparatus in an enlarged scale.
Figure 7:
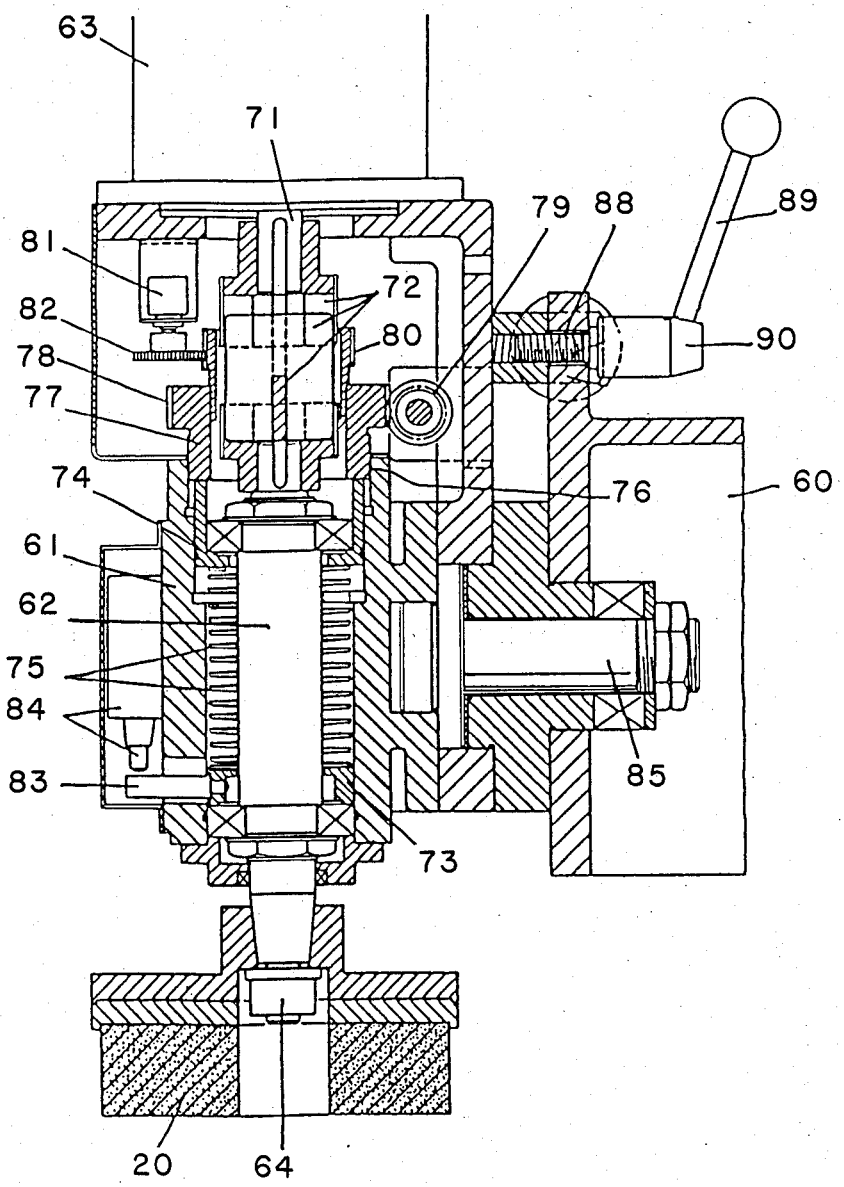
FIG. 7 is a cross-sectional side elevation view of an apparatus of this invention which shows a mechanism for adjusting contact pressure of a rotating grindstone in relation to a rotating rod-like object under grinding.

FIGS. 3 and 7 show how the grindstone 20 is driven and movable in a vertical direction. A carriage 60 is mounted on one side of a casing 59, which is fixed to the housing 29, in such a way that it can move up and down freely. The grindstone 20 is fixed to the lower end of a shaft 62 with a nut 64. The shaft 62 is held vertically inside a bearing 61, which is fixed to the carriage 60, and is caused to rotate by a motor 63 disposed on the carriage 60. An externally threaded shaft 66 mounted in the casing 59 so as to be able to rotate about a fixed position engaged with an internal thread 65 of carriage 60. A motor 67 also housed in the casing 59 rotates the shaft 66 by means of pulleys 68, 69 and a belt 70, whereby the grindstone 20 is raised or lowered in correspondence with the normal or reverse rotation of the motor 67.

The third sensor 57 detects the front end of the rod-like object A when it is just below the grindstone 20 and signals the motor 67 to lower the grindstone.

The fourth sensor 58 detects the rear end of the rod-like object A when it passes below the grindstone 20 and signals the motor to raise the grindstone. For example, the sensors 55, 56, 57 and 58 can detect the approaching front end or the departing back end of the rod-like object A by sensing whether there is a change in pressure in the gap 27, which is kept constant by an air jet, or by the use of a switch that acts when something approaches it or by other means.

FIG. 7 shows a mechanism for adjusting the contact pressure of the grindstone 20 on the rod-like object, where the shaft 62 is held closely by the bearing 61 so as to freely move up and down in it. An output shaft 71 of the motor 63 and the upper end of the shaft 62 are joined by an extensible coupler 72. A spring 75 is inserted between receiving ring 73 secured to the lower end and the ring 74 loosely held around the upper end of the shaft 62.

The inside of the upper end of the bearing 61 has a thread 76 which is engaged with an external thread at the lower end of a cylinder 77. The cylinder 77 is screwed into the bearing 61 until the lower end of the cylinder 77 comes into contact with the receiving ring 74. Hence, the contact pressure of the grindstone applied to the rod-like object can be varied by adjustment of elastic compression of the spring. The adjustment is made by changing the depth of the screwed part of the cylinder 77 into the bearing 61 The cylinder 77 can be screwed in or out of bearing 61 by turning a worm gear 79 engaged with a worm wheel 78 disposed around the upper end of the cylinder 77.

Also, as shown in FIG. 7 it is desirable to have some means for users to know the contact pressure of the grindstone. The amount of the compressive force of the spring 75 can be measured by coupling a gear 80 rotating with the cylinder 77, to a gear 82 of a potentiometer 81. The lowest limit of the grindstone is detected by a limit switch 84, which is actuated by an arm 83 that at the moment of the grindstone has just touched the object to be ground and cuts an electric current to the motor 67, which raises and lowers the carriage 60.

Figure 8:
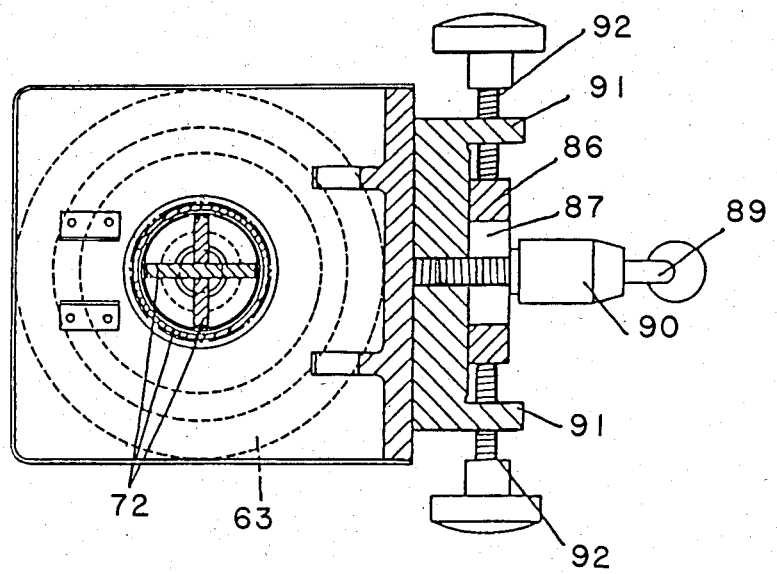
FIG. 8 is a plan view of the mechanism shown in FIG. 7.

In the meantime, grinding can also be performed with the grindstone 20 inclined at a desired angle to the rod-like object as follows: As shown in FIGS. 7 and 8, a hole 87 is formed in an arc through a projection 86 extending from the carriage 60, the arc being centered about the axis of a shaft 85, and the bearing 61 is pivotally joined to the carriage 60 by means of the shaft 85. A threaded shaft 88, projecting from the bearing 61, extends through the arcuate hole 87 so that the bearing 61 can be fixed to the carriage 60 at a desired angle tightening a nut 90 having a handle 89 on the shaft 88.

On the other hand, a projection 91 is disposed on both sides of the bearing 61 with the projection 86 movably therebetween A pair of threaded shafts 92 are screwed into respective internal threads in the opposed projections 91 until they contact both sides of projection 86. Thus, the shaft 62 held by the bearing 61 can be inclined at a desired angle by adjusting the each shaft 92.

Figure 11:
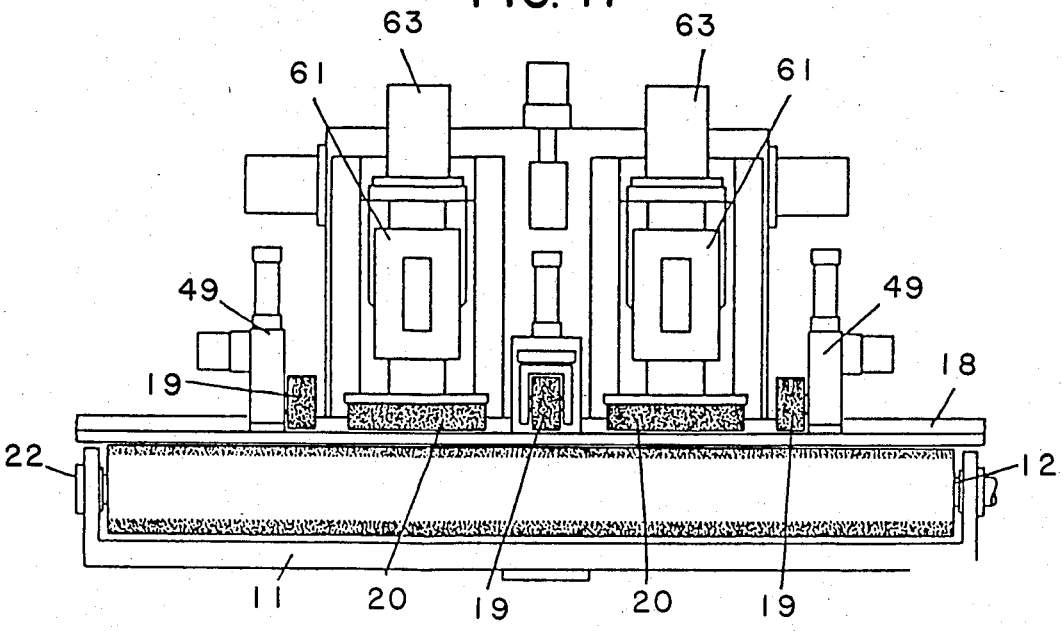
FIG. 11 is an elevation view of an apparatus of this invention which shows one of the examples in which a pair of grindstones are put to use for grinding.
Figure 9:
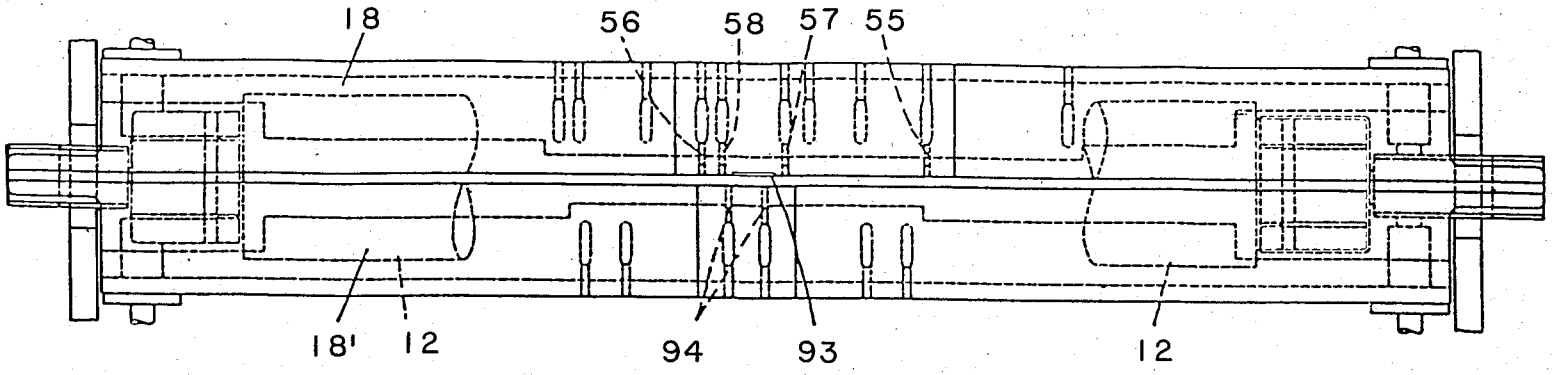
FIG. 9 is an enlarged plan view of an apparatus of this invention which shows the structure and disposition of the guide plates.
Figure 10:
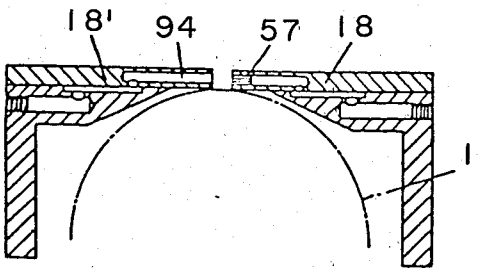
FIG. 10 is a cross-sectional side elevation view of the guide plates shown in FIG. 9.

As shown in FIG. 9, a material having wear resistance 93 is attached to the inside of the guide plate 18 at a position where the rod-like object comes in contact with it. Moreover, nozzles 94 are provided for the guide plates 18, 18' in order to spray a grinding or cooling solution on the rod-like object in contact with the grindstone. In addition, two grindstones can be placed side by side in order to perform grinding and final polishing at the same time, as shown in FIG. 11.

The manner of operation of various parts of the invention described in connection with the drawings will be explained as follows:

First, an object to be ground with a rod-like object is fed into the gap 27 formed by a pair of parallel guide plates 18, 18'. The rotating roll 12, rotates the rod-like object while, at the same time, the roll 12 moves the rod-like object in its axial direction. When the front end of the rod-like object reaches the sensor 55, the carriage 47 is lowered in response to a signal which causes the cylinder 54 to retract. The arm 49 supporting the pressure roll 19 islowered together with the carriage 47 by pressure from the spring 48. As a result, the object A is pressed down on the roll 12 by the pressure roll 19.

Subsequently, when the front end of the object reaches the point where the sensor 57 is located, a signal causes the motor 67 to rotate the externally threaded shaft 66 to lower the carriage 60 and the grindstone 20 down to the rod-like object.

Grinding is performed until the rear end of the rod-like object passes the point where the sensor 56 is located during grinding, the sensor signals the cylinder 54 to expand and the pressure roll 19 is raised to a position above the rotating roll 12.

When the rear end of the rod-like object passes the location of the sensor 58, the motor 67 begins to rotate, which causes the bearing 61 to ascend to release the contact pressure of the grindstone. When the rear end of the rod-like object passes of the location of the sensor 56, the pressure roll 19 is raised by the expansion of the cylinder 54.

In summary, a method and an apparatus have been described for putting a rod-like object to be ground in a longitudinal spaced formed by a pair of opposing guide plates located over a rotating roll, pressing a rotating grindstone down on the rod-like object and performing grinding by moving either the grindstone or the object, whereby any rod-like object that is bent easily when in contact with grindstones can be ground exactly without causing any trouble. Since the rod-like object is supported by a horizontal, rotating roll, the contact pressure of a grindstone remains constant with the result that grinding can be performed with high accuracy.

The pair of guide plates can be moved vertically and horizontally so that the width and the height of the gap formed between the guide plates can be adjusted for accommodating different diameters of rod-like objects to be ground.

What is claimed is:

1. A method of grinding a rod-like object comprising:

supporting a rod-like object on top of a roll which is rotating about a horizontal axis;

guiding said rod-like object in a gap between a pair of guide plates which extend in a longitudinal direction that is parallel to a center axis of said rod-like object;

pressing said rod-like object down on said rotating roll by means of at least one vertically movable pressure roll which is rotating about a second horizontal axis to cause rotation of said rod-like object;

grinding said rod-like object by means of at least one vertically movable grinder which presses against said rod-like object with a constant pressure;

moving said rod-like object in said longitudinal direction to thereby accurately grind said rod-like object over the entire length thereof;

sensing a front end of said moving rod-like object by means of a first sensor which causes said vertically movable pressure roll to move towards said guide plates;

sensing said front end of said moving rod-like object by means of a second sensor which causes said vertically movable grinder to move towards said guide plates;

sensing a rear end of said moving rod-like object by means of a third sensor which causes said vertically movable grinder to move away from said guide plates; and sensing said rear end of said moving rod-like object by means of a fourth sensor which causes said vertically movable pressure roll to move away from said guide plates.

2. The method of claim 1, further comprising:

pivoting a roll about said vertical axis to form a feed angle between said horizontal axis of said roll and said longitudinal direction to cause said rod-like object to move in said longitudinal direction and rotate about said center axis.

3. The method of claim 1, further comprising:

pressing said rod-like object down on said roll by means of a pair of rotating vertically movable pressure rolls, each of which is located on an opposite side of said grinder.

4. The method of claim 1, further comprising:

grinding said rod-like object by means of two vertically movable grinders; and pressing said rod-like object down on said roll by means of three rotating vertically movable pressure rolls, said three pressure rolls being separated from each other along said longitudinal direction and having one of said grinders disposed between each adjacent pair of said pressure rolls.

5. A grinding apparatus, comprising:

a frame;

a roll pivotally supported on said frame and rotatable about a horizontal axis, said roll having a surface which has a large coefficient of friction;

a pair of guide plates extending in a longitudinal direction and movably supported on said frame above a top surface of said roll, said pair of guide plates having a gap therebetween for guiding a rod-like object;

at least one pressure roll movably mounted on said frame above said guide plates for pressing the rod-like objects against said roll;

at least one grinder movably mounted on said frame above said guide plates for grinding the rod-like object held within said gap between said pair of guide plates, said grinder having means for adjusting the contact pressure between said grinder and the rod-like object being ground;

means for moving said pressure roll in a vertical direction;

means for moving said grinder in a vertical direction; and sensor means for actuating each said moving means to cause said pressure roll and said grinder to move towards said guide plates when a front end of the rod-like object is passed under said pressure roll and said grinder, respectively and to cause said pressure roll and said grinder to move away from said guide plates when a rear end of the rod-like object passes under said pressure roll and said grinder, respectively.

6. The grinding apparatus of claim 5, wherein said frame includes a pivotable roll suport which rotatably supports said roll for rotation about said horizontal axis and is pivotable about a vertical axis, said rotatable roll support having means for fixing said rotatable roll support in a desired position for adjusting the feed angle between said roll and said longitudinal direction of said guide plates.

7. The grinding apparatus of claim 5, wherein said frame includes movable support means for adjusting the vertical position of said guide plates and means for adjusting the width of said gap between said guide plates.

8. The grinding apparatus of claim 5, wherein said frame includes means for moving said pressure roll in a vertical direction, said means including a carriage which is slidably mounted on said frame, a cylinder means mounted on said frame for moving said carriage in a vertical direction and means for supporting said pressure roll on said carriage.

9. The grinding apparatus of claim 8, wherein said means for moving said pressure roll further comprises a spring connected between said frame and said carriage for urging said pressure roll towards said guide plates.

10. The grinding apparatus of claim 5, wherein said frame includes means for moving said grinder in a vertical direction, said means including a carriage which is slidably mounted on said frame, means connected between said frame and said carriage for raising and lowering said carriage and means for supporting said grinder on said carriage.

11. The grinding apparatus of claim 10, wherein said means for supporting said grinder is rotatable about a horizontal pivot axis and said grinder includes a grindstone which is rotatable about an axis which is perpendicular to said horizontal pivot axis.

12. The grinding apparatus of claim 10, wherein said means for adjusting the contact pressure between said grinder and the rod-like object being ground includes a bearing mounted on said means for supporting said grinder on said carriage, a shaft movably supported in said bearing for rotation about and movement along a center axis of said shaft, a spring connected to said shaft for applying a force to said shaft which moves said shaft towards said guide plates and spring adjustment means for varying the force exerted by said spring means, said shaft having a grindstone mounted on an end thereof towards said guide plates and said shaft being coupled to means for rotating said shaft at the other end thereof.

13. The grinding apparatus of claim 12, wherein said means for adjusting the contact pressure between said grinder and the rod-like object includes means for measuring the force exerted by said spring and includes limit switch means for stopping downward movement of said grinder when said grindstone contacts the rod-like object to be ground.

14. A grinding apparatus, comprising:

a frame;

a roll pivotably supported on said frame and rotatable about a horizontal axis, said roll having a surface which has a large coefficient of friction;

a pair of guide plates extending in a longitudinal direction and movably supported on said frame above a top surface of said roll, said pair of guide plates having a gap therebetween for guiding a rod-like object;

at least one pressure roll movably mounted on said frame above said guide plates for pressing the rod-like object against said roll;

at least one grinder movably mounted on said frame above said guide plates for grinding the rod-like object held within said gap between said pair of guide plates;

means disposed on said frame for moving said grinder in a vertical direction, said means including a carriage which is slidably mounted on said frame, means connected between said frame and said carriage for raising and lowering said carriage and means for supporting said grinder on said carriage;

means for adjusting the contact pressure between said grinder and the rod-like object being ground, said means including a bearing mounted on said means for supporting said grinder on said carriage, a shaft movably supported in said bearing for rotation about and movement along a center axis of said shaft, a spring connected to said shaft for applying a force to said shaft which moves said shaft towards said guide plates and spring adjustment means for varying the force exerted by said spring, said shaft having a grindstone mounted on an end thereof towards said guide plates and said shaft being coupled to means for rotating said shaft at the other end thereof, said means for adjusting the contact pressure between said grinder and the rod-like object further including means for measuring the force exerted by said spring and limit switch means for stopping downward movement of said grinder when said grindstone contacts the rod-like object to be ground.

* * * * *